US005429378A

United States Patent [19]

Durel-Crain

[11] Patent Number: 5,429,378

[45] Date of Patent: Jul. 4, 1995

[54] CHILD'S OBSERVATION PLATFORM

[76] Inventor: Maxie Durel-Crain, 109 Driftwood St., Lafayette, La. 70503

[21] Appl. No.: 119,615

[22] Filed: Sep. 13, 1993

[51] Int. Cl.[6] ..... B62B 7/00

[52] U.S. Cl. ..... 280/43.22; 280/87.051; 248/129; 248/364

[58] Field of Search ..... 280/43.22, 43.24, 79.2, 280/755, 87.05, 87.041, 87.051; 135/67; 108/25, 26; 47/39, 39 P, 39 M; 248/127, 129, 146, 364

[56] References Cited

U.S. PATENT DOCUMENTS

| | | | |
|---|---|---|---|
| 221,711 | 11/1879 | Wolcott | 248/146 |
| 585,931 | 7/1897 | Gridley | 47/39 M |
| 846,451 | 3/1907 | Burry | 248/129 |
| 1,021,773 | 4/1912 | Grub | 280/43.24 |
| 2,486,932 | 11/1949 | Elliott | 47/39 P |
| 2,657,735 | 11/1953 | Hughes | 135/67 |
| 3,515,404 | 6/1970 | Perego | 280/87.051 |
| 4,244,147 | 1/1981 | Geddes | 47/39 P |
| 4,770,410 | 9/1988 | Brown | 135/67 |
| 4,822,030 | 4/1989 | Cone | 280/43.24 |
| 5,183,280 | 2/1993 | Gresch | 248/129 |
| 5,273,299 | 12/1993 | Huang | 280/87.051 |
| 5,275,426 | 1/1994 | Tankersley | 280/87.051 |

FOREIGN PATENT DOCUMENTS

| | | | |
|---|---|---|---|
| 1012597 | 4/1952 | France | 47/39 |
| 640280 | 10/1935 | Germany | 280/43.22 |

*Primary Examiner*—F. Daniel Lopez
*Attorney, Agent, or Firm*—Robert Montgomery

[57] ABSTRACT

The invention relates generally to high chairs for children and but more particularly to a high-stand whereby a child standing in a container at counter top level can observe the activities of adults. This invention provides a molded shell apparatus having a receptacle therein which allows a child between the ages of six to thirty months to observe adult activities at the adults working level.

15 Claims, 2 Drawing Sheets

CHILD'S OBSERVATION PLATFORM

BACKGROUND OF THE INVENTION

1. Field of the Invention

The invention relates generally to high chairs for children and more particularly to a high-stand whereby a child standing in a container at counter top level can observe the activities of adults.

2. General Background

Children between the age of six months and two years are very active and curious about their surroundings and the activities of their parents. At this age they are either physically not able or severely restricted from exploring on their own. Therefore, children at this age must be constantly entertained and under constant supervision. This leaves little time for anything else. Various means have been developed to provide diversion so adults can go about their duties. Such devices include play pens, high chairs, and walkers. Some parents have resorted to a harness arrangement which allows the child to be carried by the parent everywhere they go. Thus, providing the child with a sense of closeness while placing them in a position to see everything being done by the adult.

It has been observed that a child simply becomes bored with its own things and is fascinated by anything new or forbidden. The child also learns from observation. Therefore, it becomes clear that a way must be found which will allow the child to be exposed to as many daily activities of the parent or guardian as possible while preferably leaving the adult as unencumbered as possible.

SUMMARY OF THE PRESENT INVENTION

This invention provides an apparatus which allows a child between the ages of six to thirty months to observe adult activities at the adult level. It's at this age, when children are just starting to stand and climb that they are the most active. They want to exercise their legs, and they want to see what the adults are doing. They need a means which will allow them to observe yet still be able to stand unrestrained. Unlike high chairs the present invention allows the child to stand unrestrained, allowing the child freedom to move, turn around, and gain leg exercise. The instant apparatus allows the child to observe the adult's activity at a safe distance and at counter top level. The apparatus can also be made mobile, allowing the apparatus to be positioned at the best and safest vantage point. The child senses their new found freedom, and as a result of their sense of being a part of the activity, the child's self esteem is enhanced. Accidents such a mashed fingers, bumped heads etc. are prevented as a result of having the child off the floor and in a secure apparatus. Although the apparatus is designed in a manner which allows the child to stand and move unrestrained, there is sufficient space for the child to squat or sit down within the container. However, the apparatus is not intended as a chair or play pen; therefore, it is recommended that the child not be left unobserved for more than a few minutes. The apparatus is configured in a manner which maintains two-thirds of the child's height below the well opening. This, in combination with the well's narrow opening, prevents the child from climbing over the edge. Unlike high chairs the high stand apparatus has a smooth, shell-like interior and exterior making it very difficult for a child to gain foot support or hand leverage of any kind. A means is provided for removing one or more of the container's well liners to accommodate the additional height of the child as he/she grows thus maintaining the low center of gravity while increasing the size of the well opening. To accommodate the need for a child to have snacks, drinks etc. a tray has been provided which allows for support only in the downward direction. Therefore, if the child attempts to use the tray as a means for climbing out of the high stand apparatus, the tray simply becomes detached. It is also anticipated that children's mobiles, stuffed toys, etc. can also be attached in a similar manner.

Since the apparatus is mobile, a stabilizing means has been incorporated which allows the apparatus to be elevated slightly above the wheels for transport. When the apparatus stands for a few seconds it returns to its original secure, stable position in contact with the support surface.

It is, therefore, an object of the present invention to provide a child's observation platform which allows the child to stand and turn around in an elevated, secure enclosure.

It is another objective of the invention to provide a means for the child platform to be easily moved when necessary but remain stable while at rest.

It is still another object of the invention to provide a child's observation platform which prevents the child from exiting the platform without assistance.

It is yet another object of the invention to provide a child's observation platform which is easily cleaned.

Another object of the invention is to provide a child's observation platform which is expandable to accommodate the child as he/she grows.

BRIEF DESCRIPTION OF TEE DRAWINGS

FIG. 1. is an isometric illustration of the preferred embodiment.

FIG. 2. is an isometric view of a second embodiment having a lower frame and a removable upper container portion.

FIG. 3. is a cross section elevation of the preferred embodiment.

FIG. 4. is a fragmentary cross section of the preferred embodiment showing the wheels extended.

FIG. 5. is an isometric view of a third embodiment having a more contoured shape and a removable upper containment.

FIG. 6. is a fragmentary cross-section of the tray attachment.

DETAILED DESCRIPTION OF THE PREFERRED EMBODIMENT

Figure 1:
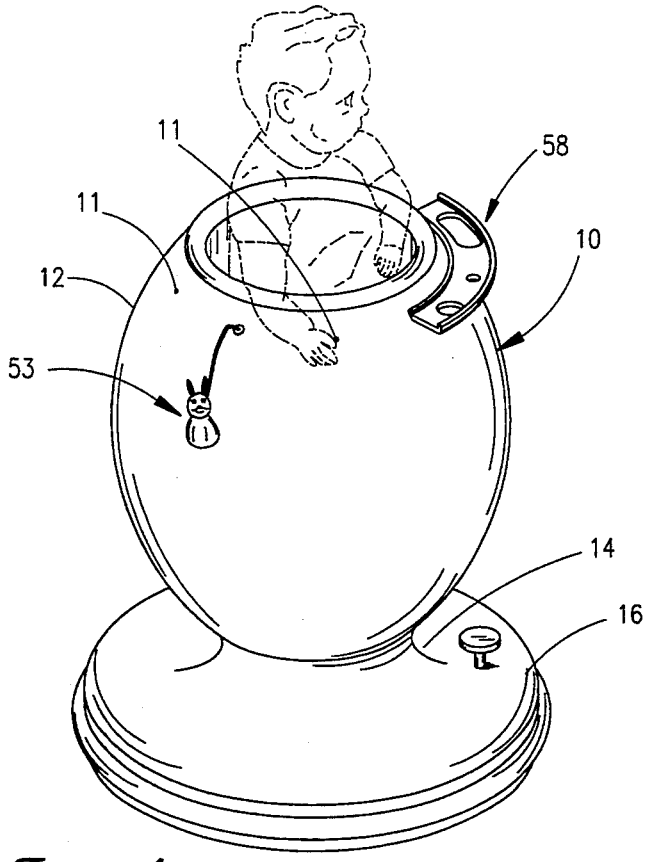
Figure 3:
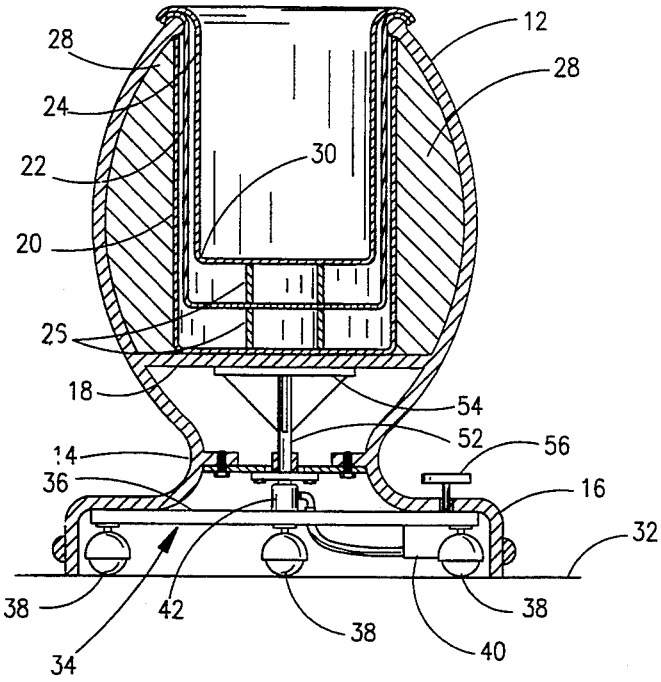

The preferred embodiment of the high stand is a rotationally molded body shell 10 as seen in FIG. 1, best described as a curvaceous goblet shape with a large upper portion 12 forming a parabolic body of revolution, a narrow middle 14, and a thinner lower portion 16, having an opening at the top and bottom. The shell 10 comprised of upper, middle and lower portions 12,14 & 16 is essentially hollow and partitioned 18 into two interior compartments. As seen in FIG. 3, the larger upper compartment, having an opening somewhat smaller than the outside diameter of the shell portion 12, is fitted with a receptacle 20 forming a well therein. The receptacle 20 being of sufficient size and depth to accommodate a small child usually less than 30 months old. The receptacle need only have sufficient depth to accommodate two-thirds of the child's height. Thus, the child's head and arms extend above the well. Additional removable receptacles 22, 24 are nested inside the first receptacle 20 to accommodate smaller children who are only just beginning to stand alone. Each of the additional receptacles are held in spaced apart relationship by spacers 26. The largest of the receptacles 20 may be fixed to the shell thereby providing additional structural rigidity. The large upper shell cavity surrounding the largest receptacle 20 is filled with foam 28 providing a means of deadening sounds which may result from the child's kicking the walls of the receptacle 20. It should be noted that the bottom to wall intersection 30 of each receptacle is well radiused, and the walls are smooth to allow for cleaning.

Figure 4:
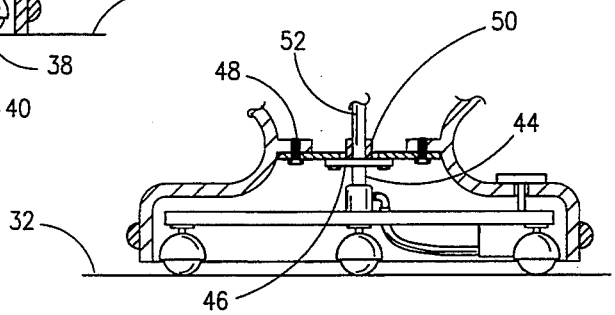

The lower compartment cavity which rest securely on a flat surface such as a floor 32, houses the mobile transporting apparatus 34. This apparatus serves several functions. The apparatus 34 comprises a heavy plate 36 which provides a counter balance at a very low center of gravity to prevent tipping of the shell structure 10. If desired, wheels 38 can be added to the lower portion of the plate 36 for transport across a surface 32. A lift jack cylinder 42 is attached to the top of the plate 36. The rod 44 as seen in FIG. 4 extending from the lift cylinder 42 is fitted with a circular disk 46 which is attached to a flange 48 extending from the interior wall of the shell 10 at the narrow middle portion 14. A socket 50 is provided in the top of the lift cylinder disk 46 to accommodate a shaft 52 fitted with a larger disk 54 which serves as a structural support for the largest receptacle 20. A pump 40 is also provided which can be actuated by pressing a pedal 56, extending through the shell 10 surface of the lower compartment 16, with ones foot. The pump 40 is plumbed to the lift cylinder 42. Thus, when the pump 40 is activated, the lift cylinder 42 is raised approximately one-half inch thereby lifting the shell 10 off the support surface 32 thereby allowing for rotation or transport across a surface 32. The pump 40 is set in a manner which allows the lift cylinder 42 to leak down after only a few seconds thereby allowing the shell 10 to settle back down in contact with the support surface 32.

Figure 6:
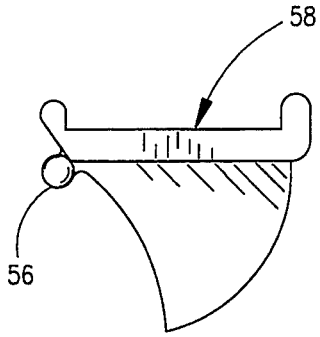

The shell portion 12 also has strategically located holes 11 as seen in FIG. 1 piercing the outer surface. These holes 54 allow for snap bead type fittings 56 as seen in FIG. 6 which in turn support trays 58, toys 53, etc. Such snap bead 56 arrangement allows for downward support only. Pulling upwards causes the bead 56 to snap out of the holes 54.

Figure 2:
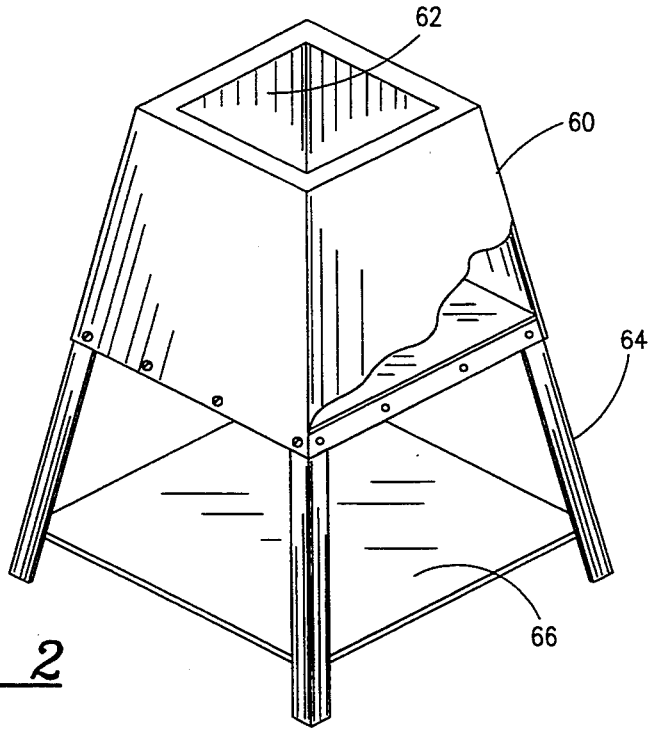

A second embodiment as seen in FIG.2 provides a more economical means of construction while still providing the essential elements of the present invention. In this embodiment a pyramid shaped upper portion 60 is employed having a square or rectangular opening slightly larger than a child's torso forming a well 62 at its truncated apex, supported by a lower frame 64 having legs which can be removed or folded for transport. The steep angle of the pyramid shape makes the platform very stable. However, a lower shelf 66 can also be provided for receiving a weight serving as a counter balance to further prevent upsets.

Figure 5:
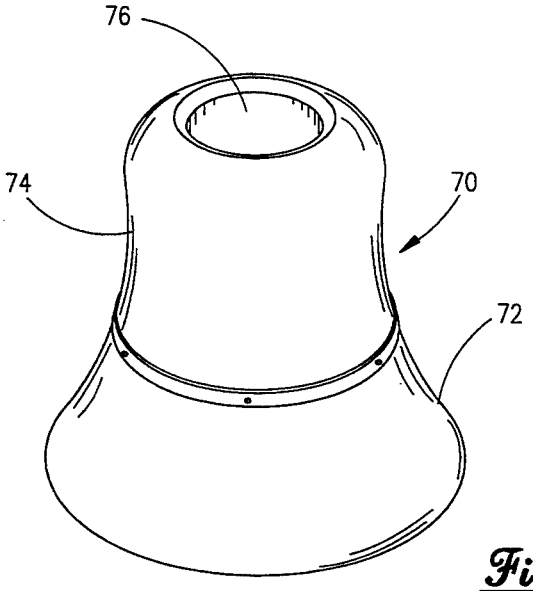

A third embodiment 70 as seen in FIG.5 depicts a more appealing bell shape structure having a weightable lower portion 72 capable of receiving and securing a cylindrical, truncated upper portion 74 having a well 76 therein with or without removable receptacles. The lower portion 72 can also be fitted with wheels.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. An enclosed observation platform of a sufficient height for a child to observe the activities of an adult setting at a table or standing at a counter comprising;

a) an elevated hollow shell frustum;

b) an upper compartment having an open mouth at its upper smaller end slightly larger than a child's torso but of sufficient size to allow a child to stand therein and turn around freely;

c) a lower compartment having a base portion larger than said upper compartment's smaller end, parallel to said open mouth; and d) a partition means for supporting a child standing within said upper compartment with a portion of said child extending through said open mouth, separating said upper compartment from said lower compartment at a depth below said open mouth approximately two thirds said child's body length.

2. An enclosed observation platform according to claim 1 wherein said hollow shell frustum is a pyramid shape.

3. An enclosed observation platform according to claim 1 wherein said hollow shell frustum is a cone shape.

4. An enclosed observation platform according to claim 1 wherein said open mouth is fitted with at least one removable liner having a flat base and cylindrical wall having depth and mouth opening sized to accommodate children of various ages and size, supported by said partition means and said open mouth.

5. An enclosed observation platform according to claim 1 wherein said upper compartment is detachable from said lower compartment.

6. An enclosed observation platform according to claim 1 wherein said upper compartment further comprises retaining means for attaching trays and tethered toys.

7. An enclosed observation platform according to claim 1 wherein said lower compartment is contains a weight means for stabilizing said hollow shell relative to a moving child standing partially within said upper compartment.

8. An enclosed observation platform according to claim 1 wherein said base portion of said lower compartment further comprises a plurality of lockable casters for transporting, said platform across a level surface.

9. An elevated enclosed platform for a child standing therein to observe activities at table or counter top level comprising;

a) a hollow body portion formed as a surface of revolution;

b) an open mouth at said bodies upper end slightly larger than a child's torso its upper edge extending downwards in a receptacle having a bottom with a depth approximately two thirds that of a child's heights, intermediate said upper and lower ends of said body portion parallel to said upper end;

c) a partition dividing said body portion into upper and lower chambers further supporting said diaphragm;

d) a flared base portion having a diameter larger than said body portion supporting said body portion;

e) a neck portion smaller in diameter than said body and base portions intermediate said body and said flared base portion; and f) a compensating weight to maintain stability relative to a child's shifting weight when standing on said partition within the confines of said open mouth.

10. An elevated enclosed platform according to claim 9 wherein said upper chamber surrounding said receptacle is filled with an insulating foam.

11. An elevated enclosed platform according to claim 9 wherein said open mouth and integral diaphragm further comprises at least one removable inner liner having depth and mouth opening sized to accommodate children of various ages and size and a cylindrical main portion with a flat base, the main portion projecting through said open mouth, supported by said receptacle and said upper edge of said mouth.

12. An elevated enclosed platform according to claim 9 wherein said flared base portion further comprises a hydraulic elevating means for raising said hollow body above a supporting surface, said elevating means having one end attached to a flange plate fastened to an annulus located within said neck portion, said means opposite end is attached to a heavy base plate having a plurality of casters attached thereto, a hydraulic operating means for activating said elevating means attached to said base plate, a foot peddle means for activating said hydraulic operating means extending through said flared base portion and a hose connecting said elevating means and said operating means.

13. An elevated enclosed platform according to claim 12 wherein said operating means is vented to allow said elevating means, when extended, to leak down after a predetermined time, returning said platform to a stable non-movable condition in contact with said support surface.

14. An elevated enclosed platform according to claim 9 wherein said body portion is fitted with a pop-away tray having downward support only.

15. A child's observation platform comprising:

a) a hollow shell frustum between 40 and 45 inch high formed as a surface of revolution, having an opening in its upper end slightly larger than a child's torso but of sufficient size to allow a child to stand therein and turn around freely, and a flat base portion parallel to said opening;

b) a partition means for supporting a child standing thereon spaced at a depth below said opening approximately two thirds that of said child's body length, dividing said frustum into upper and lower chambers with said lower chamber being larger than said upper chamber;

c) a weight means for counteracting shifting weight of said child when standing in said upper chamber, attached to said base portion;

d) a transport means for rolling said platform across a relatively flat surface; and e) a locking means for securing said transport means in a non-movable position.

* * * * *